US005764185A

United States Patent [19]

Fukushima et al.

[11] Patent Number: 5,764,185

[45] Date of Patent: Jun. 9, 1998

[54] METHOD AND APPARATUS FOR CONTROLLING ANTENNA AND TRACKING ANTENNA SYSTEM USING THE SAME

[75] Inventors: Tomoaki Fukushima; Yoji Isota, both of Tokyo, Japan

[73] Assignee: Mitsubishi Denki Kabushiki Kaisha, Tokyo, Japan

[21] Appl. No.: 704,924

[22] Filed: Aug. 28, 1996

[30] Foreign Application Priority Data

Aug. 31, 1995 [JP] Japan ..... 7-224032

[51] Int. Cl.[6] ..... H01Q 3/00

[52] U.S. Cl. ..... 342/359; 342/77

[58] Field of Search ..... 342/75, 77, 359, 342/422

[56] References Cited

U.S. PATENT DOCUMENTS

| | | | |
|---|---|---|---|
| 4,225,871 | 9/1980 | Ramari | 343/877 |
| 4,649,398 | 3/1987 | Yamamoto et al. | 343/903 |
| 4,749,924 | 6/1988 | Watanabe et al. | 318/474 |
| 5,173,708 | 12/1992 | Suzuki et al. | 342/359 |
| 5,351,060 | 9/1994 | Bayne | 342/766 |

FOREIGN PATENT DOCUMENTS 4319803 11/1992 Japan .

*Primary Examiner*—Thomas H. Tarcza
*Assistant Examiner*—Dao L. Pham
*Attorney, Agent, or Firm*—Rothwell, Figg, Ernst & Kurz

[57] ABSTRACT

A method and apparatus for controlling an antenna and a tracking antenna system using them. A rate sensor detects the angular rate of the vehicle turning. On the basis of the detected value, an error correction circuit determines the steering angle of the antenna. If it is judged from the determined angle that the vehicle is not turning or only slightly turning, a motor driving circuit suspends driving of a motor and at the same time a linear actuator locks a major gear. If it is judged that an accumulated error of a control target which is determined on the basis of the output of the rate sensor is not negligible, the error correction circuit starts a closed-loop control on the basis of a receiving signal level. In such a manner, the power consumption in the motor can be reduced.

11 Claims, 7 Drawing Sheets

METHOD AND APPARATUS FOR CONTROLLING ANTENNA AND TRACKING ANTENNA SYSTEM USING THE SAME

BACKGROUND OF THE INVENTION

1. Field of the Invention

The present invention relates to a method and apparatus for controlling an antenna (e.g., for satellite communication) on a moving body such as a vehicle or the like, and a tracking antenna system using them.

2. Description of the Prior Art

In the accompanying drawings, FIG. 12 shows an on-vehicle tracking antenna system constructed according to the prior art (see Japanese Patent Laid-Open No. Hei4-319803). This antenna system comprises an antenna 1 and a transceiver 2, all of which are used to transmit signals to a target satellite and/or to receive signals from the satellite. The antenna 1 is connected to a motor 7 through a speed reducing mechanism 8. The motor 7 is driven by a motor driving circuit 6 to steer the antenna 1 about an azimuth. The bearing of the antenna 1 to the traveling direction of the vehicle is controlled such that the antenna does not miss the satellite regardless of change in the positional relationship between the satellite and the vehicle due to the vehicle turning or the like, according to the following procedure.

When the antenna 1 has lost sight of the satellite, the transceiver 2 supplies a target capturing signal indicating that the satellite has been lost to the switches 3 and 5, the switches 3 and 5 being switched over in response thereto such that a high rate steering signal is supplied to the motor driving circuit 6. In response to such a high rate steering signal, the motor driving circuit 6 drives the motor 7 such that the antenna 1 is steered about the azimuth by the motor 7 at a high rate until it captures the satellite again. Once the antenna 1 captures the satellite, the transceiver 2 supplies a target capturing signal indicating that the satellite has been captured to the switches 3 and 5 such that an automatic tracking signal is supplied to the circuit 6, the automatic tracking signal being used to capture the satellite thereafter. When a vehicle speed detector 4 detects that the vehicle is stopped, in accordance with the detection, the switch 5 is changed over to transmit an antenna stopping signal from an external device (not shown) to the motor driving circuit 6. In response to the antenna stopping signal, the motor driving circuit 6 stops the current supply to the motor 7.

According to the prior art, it will be apparent that the current supply to the motor 7 cannot be stopped as long as the vehicle runs.

SUMMARY OF THE INVENTION

A first object of the present invention is to provide an apparatus which can be reduced in power consumption. The first object is accomplished by making it possible to stop the motor even when a moving body (e.g., vehicle) on which the apparatus is mounted is running. A second object of the present invention is to provide an apparatus which is improved in tracking performance when the signal from the target is blocked and in power consumption, and which can compensate for the pointing error of the antenna at an appropriate timing so that the target can be more accurately tracked by the antenna. The second object is accomplished by mainly using an open-loop control. A third object of the present invention is to provide an apparatus which is further reduced in power consumption. The third object is accomplished by limiting the antenna steering condition. A fourth object of the present invention is to provide an apparatus which has a reduced number of parts and which can be thus produced inexpensively. The fourth object is accomplished by improving a mechanism or circuit operatively associated with the motor or antenna or by appropriately selecting or designing the characteristics of the motor. A fifth object of the present invention is to provide an apparatus which is reduced in power consumption and also which can be produced inexpensively. The fifth object is accomplished by appropriately designing the radiation pattern of the antenna.

In a first aspect of the present invention, it provides a method of controlling the tracking operation of an antenna which is mounted on a moving body, comprising the steps of: determining that the moving body is not turning when the pointing error of the antenna relative to a target is equal to or lower than a first threshold; and stopping the current supply to a motor for steering the antenna while the moving body is not turning. In a second aspect, the present invention provides an apparatus for controlling the tracking operation of an antenna mounted on a moving body, comprising a motor for steering the antenna; and means for executing the method according to the first aspect. In a third aspect, the present invention provides a tracking antenna system for tracking a target, comprising an antenna mounted on a moving body for tracking the target and having a beam whose direction is steerable in a reference plane, the width of said beam being relatively broad to provide a relatively large threshold as the first threshold; and the apparatus according to the second aspect.

According to these aspects, the power consumption in the motor can be suppressed or shut off while the moving body is not turning (e.g., stopped or rectilinearly running). Therefore, the power consumption can be reduced in the motor, unlike the prior art in which the motor is stopped only while the moving body is stopped. In addition, the third aspect can provide the relatively large first threshold since the beam width in the reference plane is relatively broad, and hence, the power consumption can be further reduced since a frequency of stopping the current supply to the motor increases.

According to a fourth aspect of the present invention, the antenna controlling method further comprises the steps of: calculating an accumulated turning angle after termination of a closed-loop control by accumulating a turning angle of the moving body; performing an open-loop control of the motor on the basis of the turning angle until the accumulated turning angle exceeds a second threshold; and performing the closed-loop control, in place of or along with the open-loop control, of the motor on the basis of a target signal receiving condition until the target signal receiving condition is improved to be equal to or higher than a third threshold after the accumulated turning angle has exceeded the second threshold. In a fifth aspect, the present invention provides the antenna control apparatus, further comprising a step of executing the method according to the fourth aspect. In a sixth aspect, the present invention provides the tracking antenna system, further comprising means for performing the method according to the fourth aspect.

In a seventh aspect, the present invention provides the antenna control method, further comprising the steps of: performing an open-loop control of the motor on the basis of a turning angle of the moving body until a predetermined time period has passed after termination of a closed-loop control; and performing the closed-loop control, in place of or along with the open-loop control, of the motor on the basis of a target signal receiving condition until the target signal receiving condition is improved to be equal to or higher than a third threshold after the predetermined time period has passed. In an eighth aspect, the present invention provides the antenna control apparatus, further comprising means for performing the method according to the seventh aspect. In a ninth aspect, the present invention provides the tracking antenna system, further comprising means for executing the method according to the seventh aspect.

In the fourth to ninth aspects, the open-loop control is normally executed. In other words, the antenna absolute direction (e.g., azimuth relative to the true north) is kept at the direction at which the open-loop control was started, irrespective of the vehicle's turn. Even if a signal from the target is blocked by any obstruction such as a building or the like, therefore, the antenna absolute direction will be maintained at a direction immediately before the blocking, until the blocking is removed in principle. Thus, the antenna can capture the satellite at the same time when the blocking is removed.

In the fourth to ninth aspects, further, the closed-loop control is executed when a predetermined condition is fulfilled. In the fourth to sixth aspects, for example, the closed-loop control may be again performed in place of or along with the open-loop control when the accumulated turning angle exceeds the second threshold after the closed-loop control has terminated once. In the seventh to ninth aspects, the closed-loop control may be again performed in place of or along with the open-loop control when a predetermined time has passed after termination of the closed-loop control. Accordingly, in the fourth to ninth aspects, the control mode may be shifted to the mode where the open-loop control is solely performed from the mode where the closed-loop control is performed along with or in place of the open-loop control, when the target signal receiving condition is improved to be equal to or higher than the third threshold.

Here, it should be noted that the turning angle (which more particularly is a detected or estimated turning angle) generally includes an error. Therefore, the accumulated turning angle also includes an accumulated error and has correlation with the value of the accumulated error. Similarly, the time passed from termination of the closed-loop control represents the accumulated error in a direction of the antenna which is accumulated after the closed-loop control has terminated. Therefore, it can be considered that these scalars, that is, the accumulated turning angle and passed time after termination of the closed-loop control indirectly represent the pointing error of the antenna. In the fourth to ninth aspects, either of the scalars is utilized to determine whether or not the control mode should be shifted to the mode with the closed-loop control. Thus, the pointing error of the antenna can be compensated at an appropriate timing, resulting in accurate tracking of the target by the antenna.

In addition, it should be noted that the target signal receiving condition frequently fluctuates. Accordingly, if the motor is driven in accordance with the target which is determined on the basis of the target signal receiving condition, the power consumption in the motor will increase. On the contrary, in the fourth to ninth aspects, since the closed-loop control is performed only within limited circumstances and the frequency thereof is low, a reduced frequency of the motor output fluctuation is provided and hence the reduced power consumption is provided in the motor, unlike a case where the closed-loop control is executed at all times.

Furthermore, the sixth or ninth aspect provides the relatively broad beam width of the antenna in the reference plane, low precision of detecting the turning angle is allowed and thus the use of an inexpensive sensor is possible for the open-loop control.

According to a tenth aspect, the present invention provides the antenna control apparatus, further comprising means for suppressing the rotation of the antenna due to an external force while the moving body is not turning. In this aspect, the direction of the antenna relative to the moving body heading will not be changed or will be only slightly changed even when the current supply to the motor is stopped. As a result, the power consumption in the motor can be further reduced.

In an eleventh aspect, the present invention provides the antenna control apparatus, wherein the means for suppressing the rotation of the motor is attained by any one of the following measures: (a) means for mechanically suppressing the rotation of the antenna or motor due to an external force while it is being determined that the moving body is not turning, (b) a mechanism for transmitting the motor output to the antenna while suppressing the rotation of the antenna due to an external force, (c) means for generating a counterelectromotive force in the interior of the motor so as to prevent the rotation of the motor due to an external force by changing a circuit connection and (d) the motor steering the antenna which has such a property that opposes its rotation due to an external force when the current supply to the motor is stopped. The means (b) can reduce the number of parts generally forming the apparatus and thus the manufacturing cost, in comparison with the means (a). The means (c) can also reduce the manufacturing cost since it is only required to add simple parts such as switches or the like. The means (d) can further reduce the manufacturing cost since it does not require any additional mechanism or circuit.

DETAILED DESCRIPTION OF THE PREFERRED EMBODIMENTS

Figure 1:
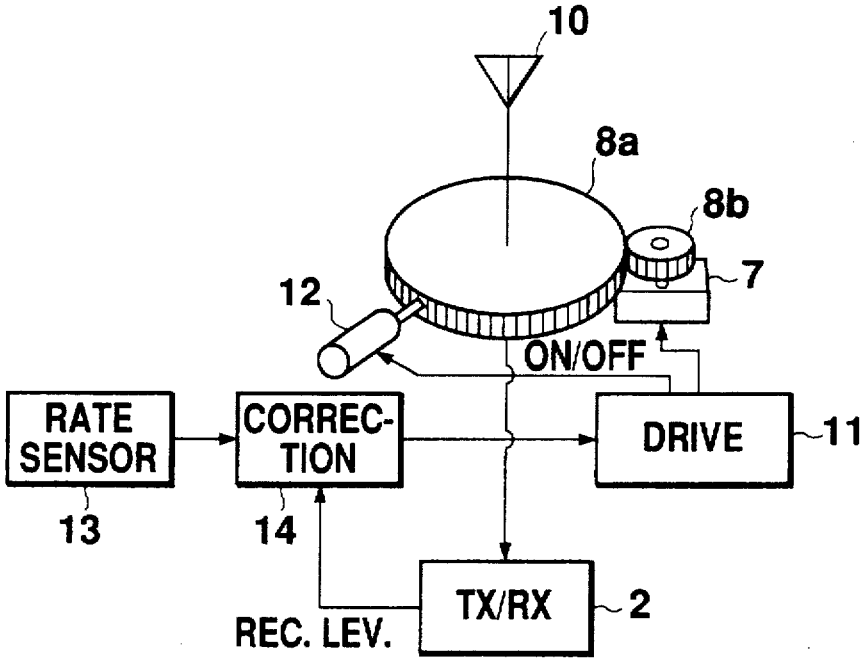
FIG. 1 is a view showing the overall layout of an apparatus relating to a first embodiment of the present invention.

Several preferred embodiments of the present invention will now be described with reference to the drawings in which parts common to all the embodiments of the present invention are designated by similar reference numerals and will not be further described.

a) First Embodiment

FIG. 1 shows the first embodiment of the present invention. The illustrated apparatus may be mounted on a moving body such as a vehicle or the like and for tracking a target such as satellite or the like using an antenna 10.

Figure 2:
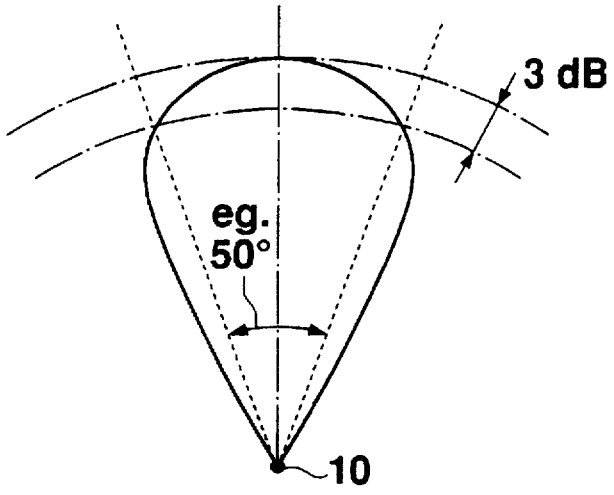
FIG. 2 is a plan view showing a radiation pattern design of an antenna.

The antenna 10 provides a beam within a reference plane (horizontal plane if the moving body is a vehicle), the beam having such a shape as shown in FIG. 2, for example. The beam width is designed to be sufficiently broad (e.g., half-power beam width equal to 50 degrees) to suppress the frequency of closed-loop control and to make the power consumption in a motor low, as will be described later.

The apparatus shown in FIG. 1 also comprises a motor 7 driven by a motor driving circuit 11. A minor gear **8*b* is provided at the output shaft of the motor 7 while a major gear 8*a* is provided at the azimuth axis of the antenna 10, i.e. these gears 8*a* and 8*b* constitute a speed reducing mechanism. On the other hand, a linear actuator 12 is disposed adjacent the outer periphery of the major gear 8*a*. The motor driving circuit 11 drives the motor 7 when steering driving the antenna 10 within the reference plane and provides an ON/OFF command to the linear actuator 12 such that the major gear 8*a*, and thus the movement of the antenna 10**, can be forcedly suspended, if necessary.

Figure 3:
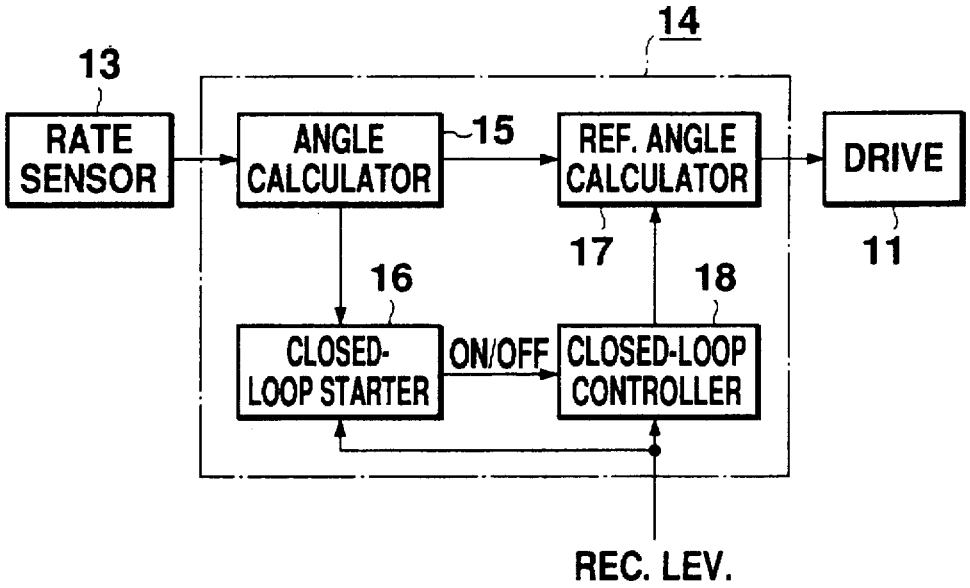
FIG. 3 is a block diagram of an error correction circuit.

The motor driving circuit 11 controls the angular position of the beam by driving the motor 7 in response to the output of a rate sensor 13 which detects the angular rate of the moving body within the reference plane, the output thereof being then supplied to an error correction circuit 14. The error correction circuit 14 includes an angle calculator 15 and a reference angle calculator 17, as shown in FIG. 3. The angle calculator 15 integrates the output of the rate sensor 13 to calculate the turning angle of the moving body within the reference plane. The reference angle calculator 17 determines the reference angle by which the antenna 10 should be steered on the basis of the calculated turning angle. The motor driving circuit 11 stops the power (current) supply to the motor 7 and provides a command to the linear actuator 12 to enforceably suspend the major gear **8*a* when the absolute value of the reference angle is less than a given first threshold. On the contrary, when the reference angle is larger than the first threshold, the motor driving circuit 11 provides a command to the linear actuator 12 to make the major gear 8*a* free to rotate and controls the motor 7 in accordance with the reference angle such that the antenna 10** will be steered by the reference angle.

In the first embodiment, thus, antenna steering to compensate for the turning of the moving body is performed on the basis of the output of the rate sensor 13. For example, when the moving body turns clockwise by 10 degrees the reference angle calculator 17 commands the motor driving circuit 11 to steer the antenna 10 counter-clockwise by 10 degrees. The motor driving circuit 11 then releases the major gear **8*a* from being locked by the linear actuator 12 and supplies the current to the motor 7 to steer the antenna 10 counter-clockwise by 10 degrees. Accordingly, if the antenna 10** was capturing the satellite just before the moving body turns, the antenna can continuously capture the satellite thereafter.

The above-described open-loop control based on the output of the rate sensor 13 enables the provision of an apparatus less influenced by blocking. In general, there are two kinds of direction error, one of which is caused by the moving body turning, another of which is caused by the satellite movement relative to the moving body. If the blocking is short in duration, the latter is negligible. Accordingly, by performing the open-loop control such that the antenna direction relative to the satellite will be maintained despite the moving body turning, even if a signal from the target is blocked by any obstruction such as a building or the like, as long as it does not last a long time, the transceiver 2 can immediately re-start the transmission of signals between the antenna 10 and the target when such a blocking is removed.

Further, since the antenna beam width in the reference plane in the first embodiment is broad, the signal transmission between the satellite and the transceiver 2 can be performed in a preferable signal condition even if the satellite direction is slightly different relative to the center of the beam, and therefore the permissible direction (azimuth) control error of the antenna 10 relative to the target can be increased. Increased permissible pointing error makes it possible to use a rate sensor that is inferior in accuracy but inexpensive, reducing the manufacturing cost of the entire system.

Additionally, since the current supply to the motor 7 will be stopped when the moving body is turning (or when the moving body is only turning slightly), the power consumption in the system can be reduced. Especially, in the case that the motor 7 is a stepping motor to which a large current must be supplied to maintain it in a non-rotation state while the motor is driven, stopping the current supply to the motor 7, that is, stopping the driving of the motor 7, with a slight or non-existent turning angle can efficiently reduce the power consumption while the moving body is moving. In addition, since the major gear **8*a* is locked by the linear actuator 12 when the current supply to the motor 7 is stopped, the antenna 10** will not be rotated by an external force.

Figure 4:
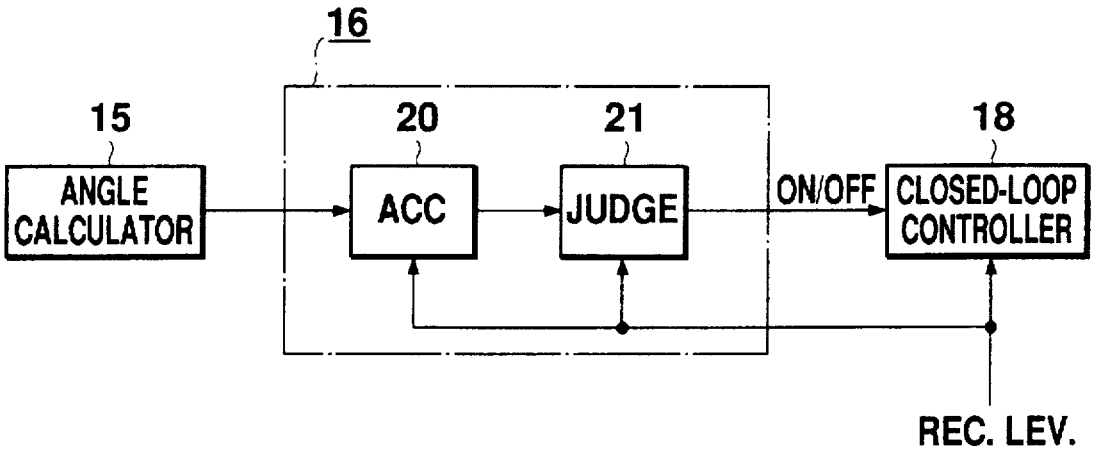
FIG. 4 is a block diagram of a closed-loop starter.

In the first embodiment, the error correction circuit 14 includes a closed-loop starter 16 and a closed-loop controller 18, as shown in FIG. 3. The closed-loop starter 16 includes an angle accumulator 20 and an accumulated angle judgment section 21, as shown in FIG. 4.

The angle accumulator 20 sequentially accumulates turning angles obtained by the angle calculator 15 and the thusobtained accumulated value is then compared with a given threshold by the accumulated angle judgment section 21. If the accumulated value from the angle accumulator 20 is higher than this threshold, the accumulated angle judgment section 21 commands the closed-loop controller 18 to start closed-loop control. The closed-loop controller 18 responds to the command for starting the closed-loop control on the basis of a receiving signal level. More particularly, the closed-loop controller 18 calculates an offset on the basis of a receiving signal level detected by the transceiver 2 (i.e., the level of a target's signal received by the antenna 10). The reference angle calculator 17 adds the offset to the turning angle obtained by the direction calculator 15 and the resulting reference angle is then supplied to the motor driving circuit 11 wherein it is used to drive the motor 7 or for any of the other purposes.

When such a closed-loop control is being performed, the bearing of the antenna 10 (e.g., azimuth) will be changed such that the signal from the target can be obtained at a higher level and therefore the pointing error of the antenna 10 relative to the target decreases. Finally, the pointing error of the antenna 10 relative to the target will become sufficiently low. When the accumulated angle judgment section 21 detects such a sufficiently low pointing error from the receiving signal level, it commands the closed-loop controller 18 to terminate the closed-loop control. At the same time, the angle accumulator 20 and accumulated angle judgment section 21 reset and re-start their operations of accumulation of the turning angle and judgment relating to the accumulated value.

In general, the turning rate from the rate sensor 13 includes an error, and hence the accumulated value thereof includes an accumulated error that affects the reference angle at which the motor 7 is driven. In this embodiment, in addition to open-loop control in the normal condition, closed-loop control is performed while the pointing error of the antenna 10 relative to the target becomes significantly large, the pointing error being represented by the accumulated turning angle. Therefore, the antenna 10 can accurately track the target regardless of using the rate sensor 13 whose accuracy is low and which causes a significant error. For example, assume that the output of the angle calculator 15 has an error of ±10% relative to the actual turning angle, and that the pointing error permissible on design is ±6 degrees. In such a case, by starting the closed-loop control in response to the detection of the fact that the accumulated value from the angle accumulator 20 exceeds 60 degrees by the judgement section 21, the pointing error of the antenna 10 can be compensated into the permissible range of ±6 degrees while using a rate sensor 13 having relatively inferior accuracy.

Figure 12:
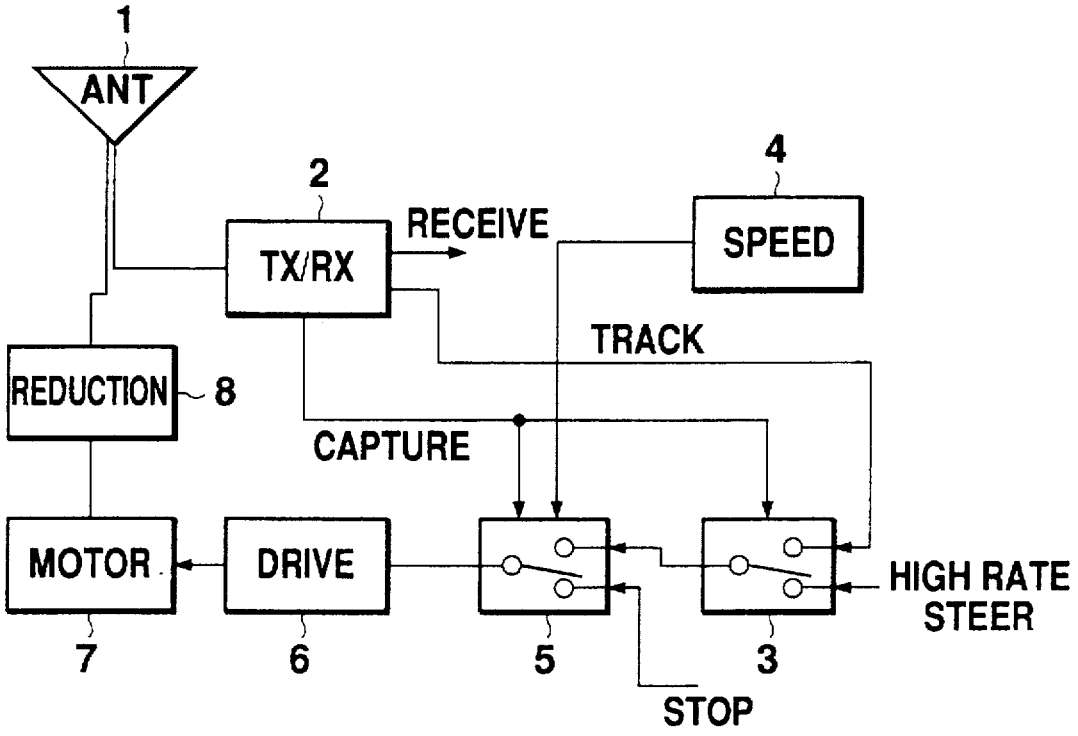
Fig. 12 PRIOR ART
FIG. 12 is a block diagram illustrating the prior art.

Finally, since the open-loop control is normally used in the first embodiment, the frequency of performing the closed-loop control becomes lower than the prior art of FIG. 12 wherein the closed-loop control is executed at all times. It is generally true that while the closed-loop control is performed on the basis of the receiving signal level or the like, the power consumption in the motor is large since the motor is driven in accordance with the receiving signal whose level fluctuates frequently. Accordingly, by suppressing the frequency of executing the closed-loop control as in the first embodiment, the power consumption of the motor 7 becomes less than the prior art.

b) Second Embodiment

Figure 5:
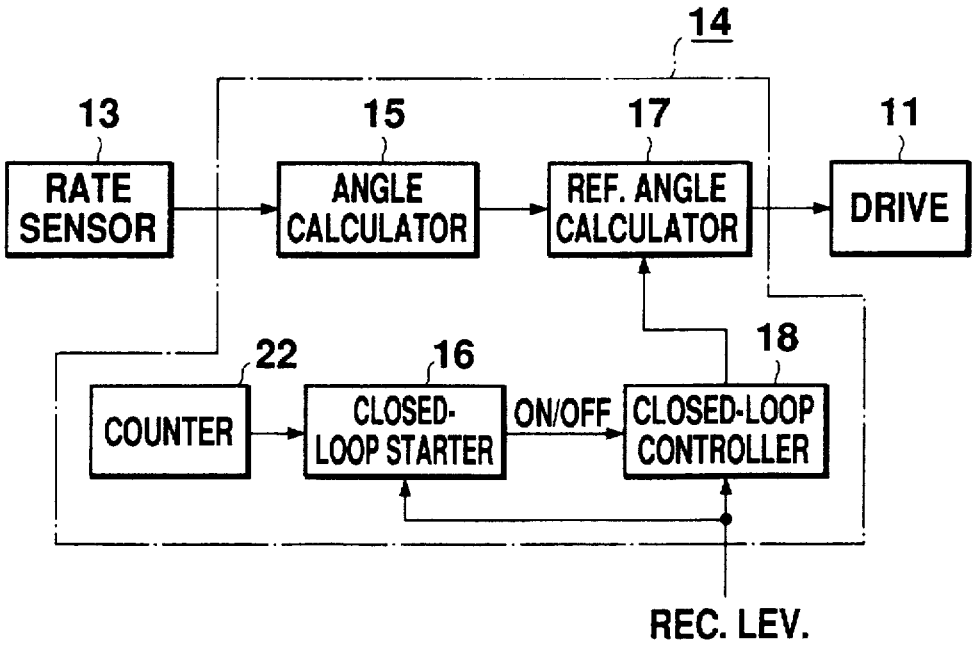
FIG. 5 is a block diagram of an error correction circuit usable in a second embodiment of the present invention.

FIG. 5 shows an error correction circuit 14 usable in the second embodiment of the present invention and including a tracking duration counter 22. In the second embodiment, the closed-loop starter 16 does not use the output of the direction calculator 15 but uses the output of the tracking duration counter 22, i.e., the closed-loop starter 16 provides a command to the closed-loop controller 18 for starting closed-loop control if the duration of the tracking counted by the tracking duration counter 22 exceeds, by a given time, the time at which the closed-loop control was terminated. In other words, a closed-loop control will be started only when a given time has passed after the preceding closed-loop control had been executed.

According to such a control, the same advantage as in the first embodiment is provided. For example, assume that an error of ±1 degree at worst appears in the output of the angle calculator 15 per one minute during which the rate sensor 13 is being used and that the pointing error permissible on design is ±6 degrees. Under this assumption, a significant error appears in the output of the angle calculator 15 when six minutes has passed after termination of the current closed-loop control. And the closed-loop starter 16 then detects that six minutes has passed after termination of the closed-loop control and restarts closed-loop control to cancel the error accumulated in antenna direction through the open-loop control mode. In such a manner, the significant error in the output of the angle calculator 15 can be prevented. The second embodiment may be combined with the first embodiment.

c) Third to Seventh Embodiments

Figure 6:
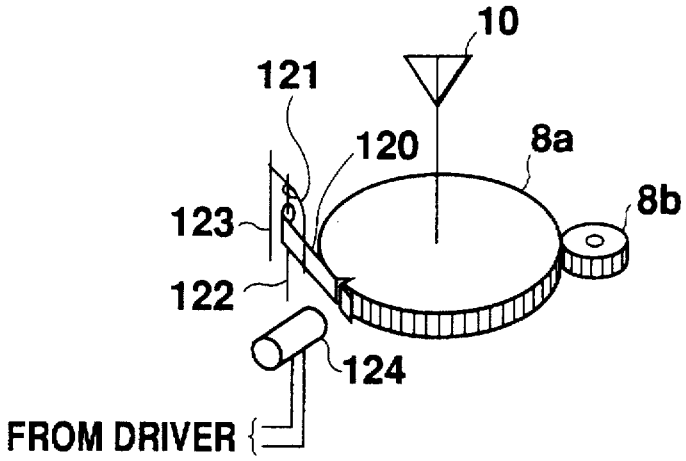
FIG. 6 is a perspective view of a mechanism used in a third embodiment of the present invention.

FIG. 6 shows an apparatus relating to the third embodiment of the present invention, particularly illustrating the peripheral structure about the major gear 8*a*. In the third embodiment, the linear actuator 12 is replaced by a blade 120, formed of a magnetic material such as iron or the like which is pressed against the major gear 8*a* by a spring 121. When driving the motor 7, the motor driving circuit 11 supplies electric current to the electromagnet 124 such that the blade 120 is attracted toward the electromagnet 124 and the major gear 8*a* being locked by the blade 120 is released. Such an arrangement can also provide the same advantage as in the first or second embodiment. In FIG. 6, reference numeral 122 designates a support for the blade 120 while 123 denotes a support for one end of the spring 121.

Figure 7:
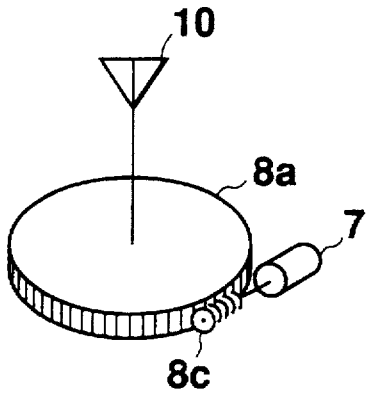
FIG. 7 is a perspective view of a mechanism used in a fourth embodiment of the present invention.

FIG. 7 shows an apparatus relating to the fourth embodiment of the present invention, particularly illustrating the peripheral structure about the major gear 8*a*, in which the minor gear 8*b*, the linear actuator 12 and blade 120 are replaced by a worm gear 8*c*. The worm gear 8*c*, which is used as means for transmitting the driving force from the motor 8 to the major gear 8*a*, prevents the rotation of the antenna caused by any external objects. The fourth embodiment can also provide the same advantage as in any one of the aforementioned embodiments through a simplified structure.

Figure 8:
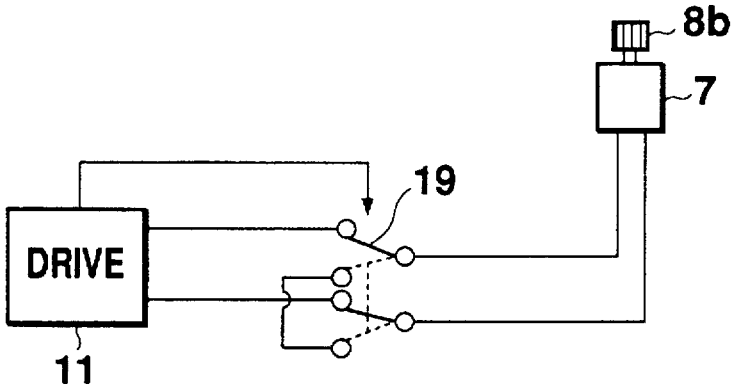
FIG. 8 is a block diagram of power wiring used in a fifth embodiment of the present invention.

FIG. 8 shows an apparatus relating to the fifth embodiment of the present invention, particularly illustrating the circuit connection about the motor driving circuit 11, in which a switch 19 is provided between the motor driving circuit 11 and the motor 7, that is, in a power supply circuit for the motor 7. The switch 19 is controlled by the motor driving circuit 11 such that the power wiring to the motor 7 will be short-circuited when the current supply to the motor 7 is to be inhibited. Therefore, rotation of the antenna 10 caused by external objects can be arrested by a counterlectromotive force generated in the interior of the motor 7. As a result, the fifth embodiment can provide a structure which is more simple and inexpensive than the first to third embodiments.

Figure 9:
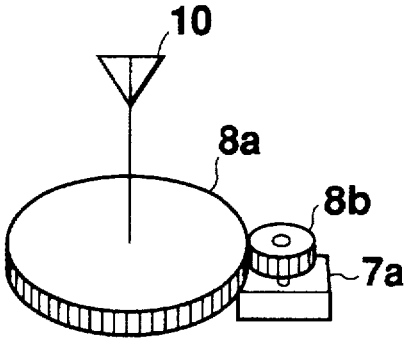
FIG. 9 is a perspective view of a mechanism used in a sixth embodiment of the present invention.

FIG. 9 shows an apparatus relating to the sixth embodiment of the present invention, particularly illustrating the peripheral structure about the motor in which the antenna 10 is steered by a self-hold stepping motor 7*a*. The self-hold stepping motor 7*a* includes an internal permanent magnet to produce a torque without a current supply. Such a motor may be implemented as a hybrid or permanent stepping motor. Even if any external force is applied to the antenna 1, its rotation can be prevented through the self-hold property of the motor 7*a*. This also provides a simplified and inexpensive structure.

Figure 10:
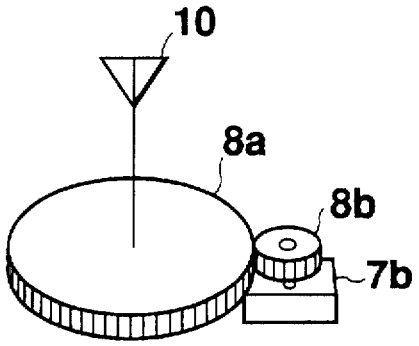
FIG. 10 is a perspective view of a mechanism used in a seventh embodiment of the present invention.

FIG. 10 shows an apparatus relating to the seventh embodiment of the present invention. Components similar to those of FIG. 9 are also omitted in this figure. A motor used in the seventh embodiment is an ultrasonic motor 7*b* which increases its shaft friction torque to oppose the rotation when the current supply is stopped. Even if any external force is applied to the antenna 10 on de-energization of the ultrasonic motor 7*b*, the rotation of the antenna 10 will be arrested or opposed by the increased shaft friction torque in the ultrasonic motor 7*b*. Thus, the seventh embodiment can also provide an inexpensive and simplified structure as in the sixth embodiment.

d) Eighth Embodiment

Figure 11:
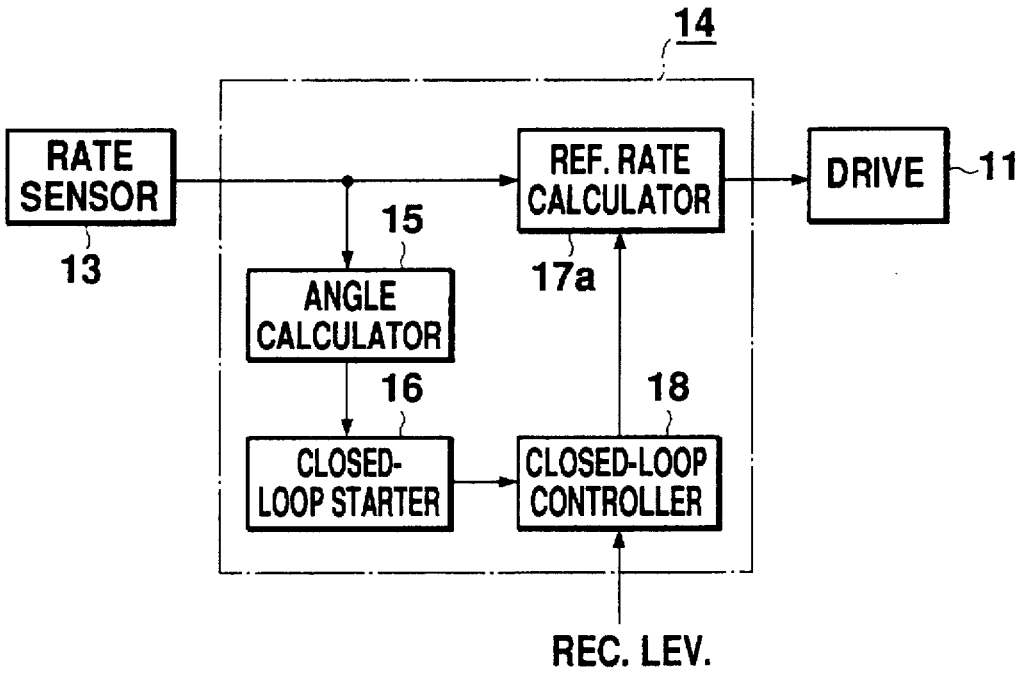
FIG. 11 is a block diagram of an error correction circuit used in an eighth embodiment of the present invention.

FIG. 11 shows an apparatus relating to the eighth embodiment of the present invention, particularly illustrating its error correction circuit 14. In the eighth embodiment, the reference direction calculator 17 of the first embodiment is replaced by a reference rate calculator 17*a*. The output of the rate sensor 13 is supplied directly to the reference rate calculator 17*a* without passing through the direction calculator 15 on one hand, and to the closed-loop starter 16 through the direction calculator 15 on the other hand. The reference rate calculator 17*a* is responsive to the angular turning rate detected by the rate sensor 13 for providing a command to the motor driving circuit 11 representing the steering rate of the antenna 10. When performing closed-loop control, the reference rate calculator 17*a* corrects the rate command to the motor driving circuit 11 in accordance with the offset from the closed-loop controller 18. The eighth embodiment can also provide the same advantage as in the aforementioned embodiments.

e) Supplement

The present invention is not limited to a tracking antenna system suitable to satellite communication, but may be similarly applied to any target other than a satellite. The moving body on which the apparatus of the present invention is to be mounted is not limited to vehicles. FIG. 2 only exemplifies the beam width of the antenna 10 within the horizontal plane. The reference plane, in which the beam width of the antenna 10 is designated to be broad can be selected according to the moving body. For example, if the moving body is a vehicle, it is preferable to select the horizontal plane as the reference plane, since the vehicle turns in a horizontal plane. In other words, if the moving body is to turn in a plane other than the horizontal plane, it is preferable to select such a plane as the reference plane. The open-loop control may be stopped when the closed-loop control is performed.

While there have been described what are at present considered to be preferred embodiments of the invention, it will be understood that various modifications may be made thereto, and it is intended that the appended claims cover all such modifications as fall within the true spirit and scope of the invention.

What is claimed is:

1. A method of controlling a target tracking operation of an antenna which is mounted on a moving body, said antenna being a directive antenna for receiving radio waves from a specific direction, comprising the steps of:

determining a pointing error of the antenna relative to a target;

determining that the moving body is not turning when the pointing error of the antenna relative to said target is equal to or lower than a first threshold; and stopping a current supply to a motor for steering the antenna while the moving body is not turning.

2. A method as defined in claim 1, further comprising the steps of:

calculating an accumulated turning angle after termination of a closed-loop control by accumulating a turning angle of the moving body;

performing an open-loop control of the motor on the basis of the turning angle until the accumulated turning angle exceeds a second threshold; and performing the closed-loop control, in place of or along with the open-loop control, of the motor on the basis of a target signal receiving condition until the target signal receiving condition is improved to be equal to or higher than a third threshold after said accumulated turning angle has exceeded the second threshold.

3. A method as defined in claim 1, further comprising the steps of:

performing an open-loop control of the motor on the basis of a turning angle of the moving body until a predetermined time has passed after termination of a closed-loop control; and performing the closed-loop control, in place of or along with the open-loop control, of the motor on the basis of a target signal receiving condition until the target signal receiving condition is improved to be equal to or higher than a third threshold after said predetermined time has passed.

4. An apparatus for controlling a target tracking operation of an antenna mounted on a moving body, said antenna being a directive antenna for receiving radio waves from a specific direction, comprising:

a motor for steering the antenna;

means for determining a pointing error of the antenna relative to a target;

means for determining that the moving body is not turning when the pointing error of the antenna relative to the target is equal to or lower than a first threshold; and means for stopping a current supply to a motor for steering the antenna while the moving body is not turning.

5. An apparatus as defined in claim 4, further comprising:

means for calculating an accumulated turning angle after termination of a closed-loop control by accumulating a turning angle of the moving body ;

means for performing an open-loop control of the motor on the basis of the turning angle until the accumulated turning angle exceeds a second threshold; and means for performing the closed-loop control, in place of or along with the open-loop control, of the motor on the basis of a target signal receiving condition until the target signal receiving condition is improved to be equal to or higher than a third threshold after said accumulated turning angle has exceeded the second threshold.

6. An apparatus as defined in claim 4, further comprising:

means for performing an open-loop control of the motor on the basis of a turning angle of the moving body until a predetermined time has passed after termination of a closed-loop control; and means for performing the closed-loop control, in place of or along with the open-loop control, of the motor on the basis of a target signal receiving condition until the target signal receiving condition is improved to be equal to or higher than a third threshold after said predetermined time has passed.

7. An apparatus as defined in claim 4, further comprising means for suppressing the rotation of the antenna due to an external force while the moving body is not turning.

8. An apparatus as defined in claim 7 wherein said means for suppressing the rotation of the antenna is attained by any one of the following measures:

means for mechanically suppressing the rotation of the antenna or motor due to an external force while it is being determined that the moving body is not turning;

a mechanism for transmitting the motor output to the antenna while suppressing the rotation of the antenna due to an external force;

means for generating a counterelectromotive force in the interior of the motor so as to prevent the rotation of the motor due to an external force by changing a circuit connection; and a motor for steering the antenna which has such a property that opposes its rotation due to an external force when the current supply to the motor is stopped.

9. A tracking antenna system for tracking a target, comprising:

an antenna mounted on a moving body for tracking the target and having a beam steerable in a reference plane, a width of said beam being relatively broad to provide a relatively large threshold as a first threshold;

a motor for driving the antenna;

means for determining a pointing error of the antenna relative to a target;

means for determining that the moving body is not turning when the pointing error of the antenna relative to the target is equal to or lower than a first threshold; and means for stopping a current supply to a motor for steering the antenna while the moving body is not turning.

10. A tracking antenna system as defined in claim 9, further comprising:

means for calculating an accumulated turning angle after termination of a closed-loop control by accumulating a turning angle of the moving body;

means for performing an open-loop control of the motor on the basis of the turning angle until the accumulated turning angle exceeds a second threshold; and means for performing the closed-loop control, in place of or along with the open-loop control, of the motor on the basis of a target signal receiving condition until the target signal receiving condition is improved to be equal to or higher than a third threshold after said accumulated turning angle has exceeded the second threshold.

11. A tracking antenna system as defined in claim 9, further comprising:

means for performing an open-loop control of the motor on the basis of a turning angle of the moving body until a predetermined time has passed after termination of a closed-loop control; and means for performing the closed-loop control, in place of or along with the open-loop control, of the motor on the basis of a target signal receiving condition until the target signal receiving condition is improved to be equal to or higher than a third threshold after said predetermined time has passed.

* * * * *